US007024152B2

(12) United States Patent
Lofthus et al.

(10) Patent No.: US 7,024,152 B2
(45) Date of Patent: Apr. 4, 2006

(54) PRINTING SYSTEM WITH HORIZONTAL HIGHWAY AND SINGLE PASS DUPLEX

(75) Inventors: Robert Michael Lofthus, Webster, NY (US); Steven Robert Moore, Rochester, NY (US); Barry Paul Mandel, Fairport, NY (US); Lisbeth Sophia Quesnel, Pittsford, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/924,106

(22) Filed: Aug. 23, 2004

(65) Prior Publication Data

US 2006/0039727 A1 Feb. 23, 2006

(51) Int. Cl.
*G03G 15/00* (2006.01)
*G03G 21/00* (2006.01)

(52) U.S. Cl. ..... 399/391; 399/381; 399/383; 399/390; 399/396; 399/397; 399/365; 399/367

(58) Field of Classification Search ..... 399/381, 399/391, 383, 390, 396, 397, 365, 367
See application file for complete search history.

(56) References Cited

U.S. PATENT DOCUMENTS 4,579,446 A 4/1986 Fujino et al.
4,587,532 A 5/1986 Asano
4,836,119 A 6/1989 Siraco et al.
5,004,222 A 4/1991 Dobashi
5,080,340 A 1/1992 Hacknauer et al.
5,095,342 A 3/1992 Farrell et al.
5,159,395 A 10/1992 Farrell et al.
5,208,640 A 5/1993 Horie et al.
5,272,511 A 12/1993 Conrad et al.
5,326,093 A 7/1994 Sollitt
5,435,544 A 7/1995 Mandel
5,473,419 A 12/1995 Russel et al.
5,489,969 A 2/1996 Soler et al.
5,504,568 A 4/1996 Saraswat et al.
5,525,031 A 6/1996 Fox
5,557,367 A 9/1996 Yang et al.
5,568,246 A 10/1996 Keller et al.
5,570,172 A 10/1996 Acquaviva
5,596,416 A 1/1997 Barry et al.
5,629,762 A 5/1997 Mahoney et al.

(Continued)

OTHER PUBLICATIONS

Morgan, P.F., "Integration of Black Only and Color Printers", Xerox Disclosure Journal, vol. 16, No. 6, Nov./Dec. 1991, pp. 381-383.

(Continued)

*Primary Examiner*—Andrew H. Hirshfeld
*Assistant Examiner*—Marvin P. Crenshaw
(74) *Attorney, Agent, or Firm*—Fay, Sharpe, Fagan, Minnich & McKee, LLP; Eugene O. Palazzo

(57) ABSTRACT

Parallel printing systems include first and second adjacent electronic printers and at least one sheet bypass section extending around the second electronic printer to provide a sheet transporting path overlying the second electronic printer and bypassing the second electronic printer. The sheet bypass section includes an output for merging printed sheets from the first electronic printer with printed sheets printed by the second electronic printer. The output preferably comprises a intermediate transport section having a first input aligned with the output of the bypass section and a second input aligned with the output of the second electronic printer.

10 Claims, 1 Drawing Sheet

U.S. PATENT DOCUMENTS

| | | | | |
|---|---|---|---|---|
| 5,710,968 | A | 1/1998 | Clark et al. | |
| 5,778,377 | A | 7/1998 | Marlin et al. | |
| 5,884,910 | A | 3/1999 | Mandel | |
| 5,963,770 | A * | 10/1999 | Eakin | 399/364 |
| 5,995,721 | A | 11/1999 | Rourke et al. | |
| 6,059,284 | A | 5/2000 | Wolf et al. | |
| 6,125,248 | A | 9/2000 | Moser | |
| 6,241,242 | B1 | 6/2001 | Munro | |
| 6,297,886 | B1 | 10/2001 | Cornell | |
| 6,341,773 | B1 | 1/2002 | Aprato et al. | |
| 6,384,918 | B1 | 5/2002 | Hubble, III et al. | |
| 6,450,711 | B1 | 9/2002 | Conrow | |
| 6,476,376 | B1 | 11/2002 | Biegelsen et al. | |
| 6,476,923 | B1 | 11/2002 | Cornell | |
| 6,493,098 | B1 | 12/2002 | Cornell | |
| 6,537,910 | B1 | 3/2003 | Burke et al. | |
| 6,550,762 | B1 | 4/2003 | Stoll | |
| 6,554,276 | B1 | 4/2003 | Jackson et al. | |
| 6,577,925 | B1 | 6/2003 | Fromherz | |
| 6,607,320 | B1 | 8/2003 | Bobrow et al. | |
| 6,608,988 | B1 | 8/2003 | Conrow | |
| 6,612,566 | B1 | 9/2003 | Stoll | |
| 6,612,571 | B1 | 9/2003 | Rider | |
| 6,621,576 | B1 | 9/2003 | Tandon et al. | |
| 6,633,382 | B1 | 10/2003 | Hubble, III et al. | |
| 6,639,669 | B1 | 10/2003 | Hubble, III et al. | |
| 6,786,149 | B1 * | 9/2004 | Lomoine et al. | 101/223 |
| 6,819,906 | B1 | 11/2004 | Herrmann et al. | |
| 2002/0078012 | A1 | 6/2002 | Ryan et al. | |
| 2002/0103559 | A1 | 8/2002 | Gartstein | |
| 2003/0077095 | A1 | 4/2003 | Conrow | |
| 2004/0057070 | A1 * | 3/2004 | Hanazato | 358/1.14 |
| 2004/0085561 | A1 | 5/2004 | Fromherz | |
| 2004/0085562 | A1 | 5/2004 | Fromherz | |
| 2004/0088207 | A1 | 5/2004 | Fromherz | |
| 2004/0150156 | A1 | 8/2004 | Fromherz et al. | |
| 2004/0150158 | A1 | 8/2004 | Biegelsen et al. | |
| 2004/0153983 | A1 | 8/2004 | McMillan | |
| 2004/0216002 | A1 | 10/2004 | Fromherz et al. | |
| 2004/0225391 | A1 | 11/2004 | Fromherz et al. | |
| 2004/0225394 | A1 | 11/2004 | Fromherz et al. | |
| 2004/0247365 | A1 | 12/2004 | Lofthus et al. | |

OTHER PUBLICATIONS

Desmond Fretz, "Cluster Printing Solution Announced", Today at Xerox (TAX), No. 1129, Aug. 3, 2001.
U.S. Appl. No. 10/761,522, filed Jan. 21, 2004, Mandel et al.
U.S Appl. No. 10/785,211, filed Feb. 24, 2004, Lofthus et al.
U.S. Appl. No. 10/881,619, filed Jun. 30, 2004, Bobrow.
U.S. Appl. No. 10/917,676, filed Aug. 13, 2004, Lofthus et al.
U.S. Appl. No. 10/917,768, filed Aug. 13, 2004, Lofthus et al.
U.S Appl. No. 10/924,106, filed Aug. 23, 2004, Lofthus et al.
U.S. Appl. No. 10/924,113, filed Aug. 23, 2004, deJong et al.
U.S. Appl. No. 10/924,458, filed Aug. 23, 2004, Lofthus et al.
U.S. Appl. No. 10/924,459, filed Aug. 23, 2004, Mandel et al.
U.S. Appl. No. 10/933,556, filed Sep. 3, 2004, Spencer et al.
U.S. Appl. No. 10/953,953, filed Sep. 29, 2004, Radulski et al.
U.S. Appl. No. 10/999,326, filed Nov. 30, 2004, Grace et al.
U.S. Appl. No. 10/999,450, filed Nov. 30, 2004, Lofthus et al.
U.S. Appl. No. 10/000,158, filed Nov. 30, 2004, Roof.
U.S. Appl. No. 11/000,168, filed Nov. 30, 2004, Biegelsen et al.
U.S. Appl. No. 11/000,258, filed Nov. 30, 2004, Roof.
U.S. Appl. No. 11/001,890, filed Dec. 2, 2004, Lofthus et al.
U.S. Appl. No. 11/002,528, filed Dec. 12, 2004, Lofthus et al.
U.S. Appl. No. 11/051,817, filed Feb. 4, 2005, Moore et al.
U.S. Appl. No. 11/070,681, filed Mar. 2, 2005, Viturro et al.
U.S. Appl. No. 11/081,473, filed Mar. 16, 2005, Moore.
U.S. Appl. No. 11/069,020, filed Feb. 28, 2005, Lofthus et al.
U.S. Appl. No. 11/089,854, filed Mar. 25, 2005, Clark et al.
U.S. Appl. No. 11/090,498, filed Mar. 25, 2005, Clark.
U.S. Appl. No. 11/090,502, filed Mar. 25, 2005, Mongeon.
U.S. Appl. No. 11/095,378, filed Mar. 31, 2005, Moore et al.
U.A. Appl. No. 11/094,998, filed Mar. 31, 2005, Moore et al.
U.S. Appl. No. 11/094,864, filed Mar. 31, 2005, de Jong et al.
U.S. Appl. No. 11/095,872, filed Mar. 31, 2005, Julien et al.
U.S. Appl. No. 11/102,355, filed Apr. 8, 2005, Fromherz et al.
U.S. Appl. No. 11/084,280, filed Mar. 18, 2005, Mizes.
U.S. Appl. No. 11/109,566, filed Apr. 19, 2005, Mandel et al.
U.S. Appl. No.11/109,558, filed Apr. 20, 2005, Furst et al.
U.S. Appl. No. 11/109,996, filed Apr. 20, 2005, Mongeon et al.
U.S. Appl. No. 11/093,229 filed Mar. 29, 2005, Julien.
U.S. Appl. No. 11/102,899, filed Apr. 8, 2005, Crawford et al.
U.S. Appl. No. 11/102,910, filed Apr. 8, 2005, Crawford et al.
U.A. Appl. No. 11/115,766, filed Apr. 27, 2005, Grace.
U.S. Appl. No. 11/120,589, filed May 3, 2005, Contino.
U.S. Appl. No. 11/102,332, filed Apr. 8, 2005, Hindi et al.

* cited by examiner

PRINTING SYSTEM WITH HORIZONTAL HIGHWAY AND SINGLE PASS DUPLEX

BACKGROUND

The present exemplary embodiments relate to media (e.g., document or paper) handling systems and systems for printing thereon and is especially applicable for printing systems comprising a plurality of associated marking engines or image output terminals ("IOTs").

The subject application is related to the following copending applications: U.S. Ser. No. 10/924,113, for "Printing System with Inverter Disposed For Media Velocity Buffering and Registration";

U.S. Ser. No. 10/924,459, for "Parallel Printing Architecture Consisting of Containerized Image Marking Engine Modules"; and U.S. Ser. No. 10/924,458, for "Print Sequence Scheduling for Reliability".

Printing systems including a plurality of IOTs are known and are generally referred to as tandem engine printers or cluster printing systems. See U.S. Pat. No. 5,568,246. Such systems facilitate expeditious duplex printing (both sides of a document are printed) with the first side of a document being printed by one of the IOTs and the other side of the document being printed by another so that parallel printing of sequential documents can occur. The document receives a single pass through the first IOT, is inverted and then a single pass through the second IOT for printing on the second side so effectively the document receives a single pass through the system but is duplex printed. Single pass duplex printing can be much faster than duplex printing in a single IOT.

However, the system must also be capable of simplex (one-sided) printing. In this case, if the document were printed on the one side at the first IOT, then transported through a second sequential IOT, its transport would consume the transport path through the second IOT with no printing purpose but delivery to a finishing module. Use of the second IOT as merely a transport path is an inefficient use of the module when it could be parallel printing sheets along with the first IOT. Another aspect of such inefficiency is that an IOT has a limit to transport speeds through the image transfer zone of the IOT, which transport speed is usually slower than a document can be transported through other portions of the system.

Especially for parallel printing systems, architectural innovations which effectively preclude non-marking transport through an IOT can enhance document process path reliability and increase system efficiency.

BRIEF SUMMARY

The proposed development comprises a tightly integrated parallel printing architecture for single pass duplex printing of documents, including a horizontal highway transport section for bypassing an IOT. More particularly, the subject tandem printing system includes at least first and second adjacent electronic printers with outputs of printed sheets and with both simplex and duplex printing capability. The printers include internal duplex loop paths for duplex printing capability in the event that the single pass duplex mode is unavailable and integrated outputs for cooperative shared printing of a print job at a higher printing rate than the capability of an individual IOT. At least one sheet bypass section extends over the second electronic printer to provide a sheet transporting path overlying the second electronic printer and bypassing the second electronic printer. The bypass section has a sheet input for receiving printed sheets printed by the first electronic printer for bypassing sheet transport over the second electronic printer, and a sheet output for merging the printed sheets from the first electronic printer with printed sheets printed by the second electronic printer.

The electronic printers include printer sheet transporting paths for sheet transport operating at process speed while the bypass module includes a bypass module transporting path operating at highway speed significantly different from the process speed of the printer.

A intermediate transport section is disposed between the first and second printers for selectively transporting the printed sheets through a sheet transporting path from a sheet output of the first electronic printer to either the sheet input of the sheet bypass section or sheet input of the second electronic printer.

A second intermediate transport section is disposed adjacent to sheet output of the second printer and the bypass for selectively compiling sheets for transport to a finishing module.

Advantages of the exemplary embodiments result from the transporting of a document through the bypass section to preclude a transport through the second printer at a faster speed than the document could be transported through the second printer, and while freeing the second printer to perform printing tasks in parallel with the printing tasks of the first printer.

DETAILED DESCRIPTION OF THE EXEMPLARY EMBODIMENTS

Figure 1:
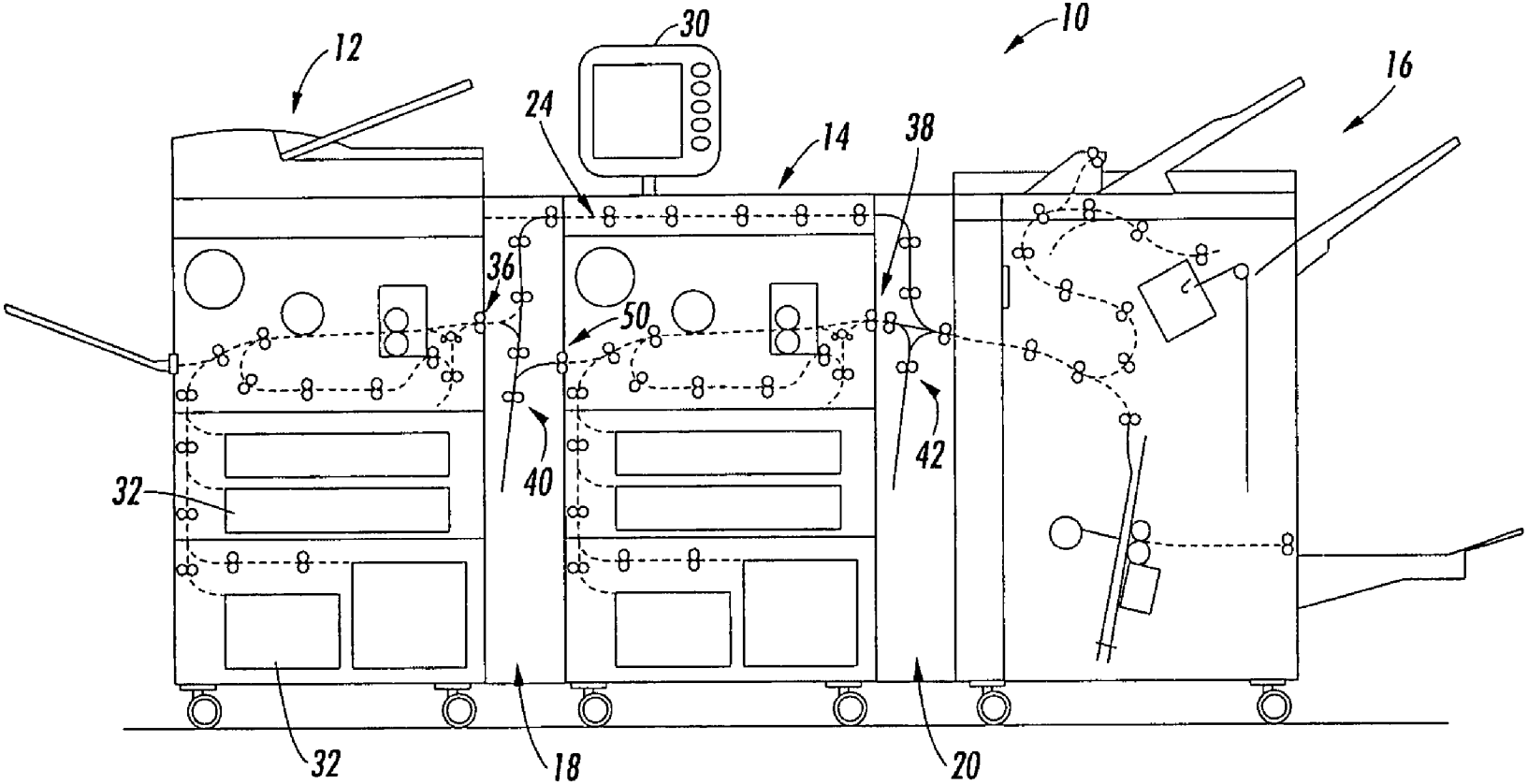
FIG. 1 shows a schematic view of a printing system illustrating selective architectural embodiments of the subject development.

With reference to the drawing, the showing is for purposes of illustrating alternative embodiments and not for limiting same. FIG. 1, shows a schematic view of a printing system comprising a plurality of marking engines, IOTs or printers associated for tightly integrated parallel printing of documents within the system. More particularly, printing system 10 includes primary elements comprising a first IOT 12, a second IOT 14 and a finisher assembly 16. Connecting these three elements are two intermediate transport section assemblies 18, 20 ("ITs"). The document outputs of the first IOT can be selectively directed by the first intermediate transport assembly 18 to either the second IOT 14 or up and over the second IOT 14 through a bypass section 24 and then to the second intermediate transport section 20 and finishing assembly 16. Where a document is to be duplex printed, the first intermediate transport section 18 transports a document to the second IOT 14 for duplex printing. The duplex printed document thus undergoes a single pass through the first and second IOTs 12, 14. In order to maximize marking paper handling reliability and to simplify system jam clearance, the IOTs are normally run in a simplex mode, not an inverting duplex printing mode in each of the IOTs. The details of practicing parallel simplex printing and duplex printing through tandemly arranged marking engines is known and can be appreciated with reference to the foregoing cited U.S. Pat. No. 5,568,246. Control station 30 allows an operator to selectively control the details of a desired print job.

The IOTs 12, 14 are conventional in this general illustration and include a plurality of document feeder trays 32 for holding different sizes of sheets that can receive the desired print markings from the image transfer portions of each IOT. It is important to note though that each IOT includes a sheet output 36, 38 for communicating the output sheets to the intermediate transport sections 18, 20. Each transport section 18, 20 includes an inverter assembly 40, 42 for selectively inverting the sheet for duplex printing or for compiling in the finishing assembly 16.

The transport sections 18, 20 and the bypass section 24 are comprised of a plurality of nip rollers for grasping and transporting the document in a driven manner with known variable speed motor and belt assemblies (not shown). The independent control of the nip rollers in the transport sections 18, 20, 24 allows the rollers to be driven at speeds different than the process speeds of the IOTs 12, 14. More particularly, when the nip rollers of the transport sections are driven at a faster speed than the process speed of the IOTs, the overall system speed can be correspondingly increased. As a simplex printed document is output from the first IOT at sheet output 36, and thereby released from the process path nip rollers of the first IOT, the first intermediate transport section 18 can independently grasp and transport the document. When its transport is to the second IOT for duplex printing, it may have to be transported to second IOT sheet input 50 at a process path speed, but when the document can be transported to bypass the second IOT 14 through the bypass section 24, it can be transported at a highway speed significantly different than the required process path speed. The first and second intermediate transport sections 18, 20 are slightly different in that the first intermediate transport section includes a single input aligned with the sheet output of the first IOT, yet includes two outputs. The first output being aligned with the input 50 of the second IOT, while the second output is aligned with the input to the bypass section 24. The second intermediate transport section is only a single output aligned with the input to the finishing module 16, but has two inputs, the first input being aligned with the output of the bypass section 24 and the second input being aligned with the sheet output 38 of the second IOT. Alternative finishing module architectures are known with several inputs that could be respectively aligned with the bypass section outlet and the second IT output.

Although the highway speed of the transport sections has been suggested to be a higher speed than the process speed of the printers, the independent control of the nip rollers of the sections 18, 20, 24 permits a selectively velocity transport and in some cases it can be foreseen, as for certain compiling requirements, that the transport sections may have to even slow down the document transport from a speed slower than the process path speed.

Another alternative embodiment comprises a second bypass section (not shown) overlying the first IOT in such systems where a supplemental input module is provided for the selective feeding of sheets into the system. In this alternative embodiment, sheets from the supplemental input source may be merged or interposed with document outputs from a first IOT 12 and a second IOT 14.

Another alternative embodiment comprises a third IOT (not shown) which is located to the right of IOT 14. In this embodiment, intermediate transport section 20 is relocated to the right of the third IOT, and a second instance of intermediate transport section 18 is located to the right of IOT 12. Also, a second instance of bypass transport section 24 is located above the third IOT. In this embodiment, all three IOTs can supply document sheets cooperatively to the finishing assembly 16. Additionally, the second IOT 14 can supply documents to the third IOT for single pass duplex printing.

It is to be appreciated that in the above embodiments, not all IOTs are required to have equivalent printing capabilities or speeds. For example, it is possible that both a high speed black and white printer and a lower speed color printer can be integrated within this system.

The exemplary embodiments have been described with reference to the specific embodiments. Obviously, modifications and alterations will occur to others upon reading and understanding the preceding detailed description. It is intended that the exemplary embodiments be construed as including all such modifications and alterations insofar as they come within the scope of the appended claims or the equivalents thereof.

The invention claimed is:

1. A tandem printing system in which at least first and second adjacent electronic printers with outputs of printed sheets and with both simplex and duplex printing capability, including internal duplex loop paths for said duplex printing capability, said first and second electronic printers having integrated outputs for cooperative shared printing of a print job at a higher printing rate than either individual said electronic printer, or optional individual printing by individual said electronic printers, in which at least one sheet bypass section is provided, said sheet bypass section extending around said second electronic printer to provide a sheet transporting path independent from said second electronic printer and bypassing internal transporting paths of the second electronic printer, the transporting paths of the second electronic printer operating at a process speed, said sheet bypass section having a sheet input for receiving printed sheets printed by said first electronic printer for bypassing sheet transport through the second electronic printer, and a sheet output for merging said printed sheets from said first electronic printer with printed sheets printed by said second electronic printer; and, wherein the transporting path of the sheet bypass section operates at a highway speed, the highway speed being different than the process speed.

2. The printing system of claim 1 further including an intermediate transport section intermediately disposed between the first electronic printer and the sheet bypass section for selectively transporting the printed sheets through a sheet transporting path from a sheet output of the first electronic printer to either the sheet input of the sheet bypass section or a sheet input of the second electronic printer.

3. The printing system of claim 2 wherein the intermediate transport section includes a sheet inverter.

4. The printing system of claim 2 further including a second intermediate transport section having a first input aligned with the output of the sheet bypass section and a second input aligned with a sheet output of the second electronic printer.

5. The printing system of claim 4 wherein the sheet output comprises a finishing module disposed for receiving printed sheets and stacking a print job, the finishing station having an input aligned with an output of the second intermediate transport section.

6. The printing system of claim 4 wherein the intermediate transport section has a transporting path capable of operating at the process speed of the printer and at a highway speed being independent and different from the process speed of the printer.

7. An integrated parallel printing system for single pass duplex printing comprising a modular array of at least a first and second image output terminal ("IOTs") horizontally disposed side-by-side, at least one bypass transport section and at least one intermediate transport section, wherein each of the IOTs has both simplex and duplex printing capabilities including a simplex path and an internal duplex loop path for the duplex printing capability, sheet transport through the paths of the IOTs occurring at a process speed, the bypass transport section being disposed to selectively receive a printed sheet from the first IOT and extend over the second IOT to provide a sheet bypass path for the printed sheet around and spaced from the second IOT, sheet transport through the bypass transport section occurring at a highway speed which is faster than the process speed, and the intermediate transport section has first and second inputs associated with outputs of the bypass transport section and the second IOT, respectively, whereby cooperative shared printing by the IOTs provides a higher printing and finishing rate for a print job than either IOT individually.

8. The printing system of claim 7 further including a second intermediate transport section intermediately disposed between the first IOT printer and the bypass transport section for selectively transporting the printed sheets through a sheet transporting path from a sheet output of the first IOT printer to either a sheet input of the bypass transport section or a sheet input of the second IOT.

9. The printing system of claim 8 wherein the intermediate transport sections include a sheet inverter.

10. The printing system of claim 8 wherein the intermediate transport sections have a transporting path capable of operating at the process speed of the printer and at the highway speed.

* * * * *